US011162052B2

(12) United States Patent
Qiu et al.

(10) Patent No.: US 11,162,052 B2
(45) Date of Patent: Nov. 2, 2021

(54) ELECTRORHEOLOGICAL FLUID

(71) Applicant: SUN YAT-SEN UNIVERSITY, Guangdong (CN)

(72) Inventors: Zhaohui Qiu, Guangdong (CN); Xiaomin Xiong, Guangdong (CN)

(73) Assignee: SUN YAT-SEN UNIVERSITY, Guangdong (CN)

( * ) Notice: Subject to any disclaimer, the term of this patent is extended or adjusted under 35 U.S.C. 154(b) by 41 days.

(21) Appl. No.: 16/515,029

(22) Filed: Jul. 18, 2019

(65) Prior Publication Data

US 2020/0024543 A1 Jan. 23, 2020

(30) Foreign Application Priority Data

Jul. 19, 2018 (CN) ..... 201810796573.8
Jul. 19, 2018 (CN) ..... 201810796959.9

(51) Int. Cl.

| | |
|---|---|
| ***C10M 169/02*** | (2006.01) |
| ***C10M 113/02*** | (2006.01) |
| ***C10M 113/08*** | (2006.01) |
| ***C10M 113/06*** | (2006.01) |
| ***C10M 177/00*** | (2006.01) |
| ***C10M 107/50*** | (2006.01) |
| *C10N 20/06* | (2006.01) |
| *C10N 40/08* | (2006.01) |
| *C10N 40/16* | (2006.01) |

(Continued)

(52) U.S. Cl.

CPC ..... *C10M 169/02* (2013.01); *C10M 107/50* (2013.01); *C10M 113/02* (2013.01); *C10M 113/06* (2013.01); *C10M 113/08* (2013.01); *C10M 177/00* (2013.01); *C10M 2201/0416* (2013.01); *C10M 2201/056* (2013.01); *C10M 2201/0626* (2013.01); *C10M 2229/0415* (2013.01); *C10N 2020/06* (2013.01); *C10N 2040/045* (2020.05); *C10N 2040/08* (2013.01); *C10N 2040/16* (2013.01); *C10N 2050/015* (2020.05); *C10N 2070/00* (2013.01)

(58) Field of Classification Search

CPC ..... C10M 169/02; C10M 113/02; C10M 113/08; C10M 113/06; C10M 177/00; C10M 107/50; C10M 2229/0415; C10M 2201/0416; C10M 2201/056; C10M 2201/0626; C10N 2020/06; C10N 2040/08; C10N 2040/16; C10N 2040/045; C10N 2050/015; C10N 2070/00

See application file for complete search history.

(56) References Cited

U.S. PATENT DOCUMENTS 5,501,809 A * 3/1996 Schober ..... C10M 171/001 252/572
6,280,658 B1 * 8/2001 Atarashi ..... C10M 171/001 252/572

(Continued)

*Primary Examiner* — Cephia D Toomer
(74) *Attorney, Agent, or Firm* — JCIPRNET

(57) ABSTRACT

The present invention provides an electrorheological fluid, which includes a dielectric particle, a conductor particle and insulating oil, and the dielectric particle is evenly dispersed in the insulating oil; wherein the conductor particle is evenly dispersed in the insulating oil or inlaid in an interior and on a surface of the dielectric particle. The electrorheological fluid has the advantages of high shear stress, long service life, good temperature stability and small leakage current.

8 Claims, 7 Drawing Sheets

(51) Int. Cl.

| | |
|---|---|
| *C10N 40/04* | (2006.01) |
| *C10N 50/00* | (2006.01) |
| *C10N 70/00* | (2006.01) |

(56) References Cited

U.S. PATENT DOCUMENTS

| | | | | |
|---|---|---|---|---|
| 2004/0105980 | A1* | 6/2004 | Sudarshan | H01F 1/447<br>428/404 |
| 2013/0115462 | A1* | 5/2013 | Mazyar | C10M 171/001<br>428/403 |

* cited by examiner

ELECTRORHEOLOGICAL FLUID

CROSS-REFERENCE TO RELATED APPLICATION

This application claims the priority benefit of China application serial no. 201810796573.8, filed on Jul. 19, 2018, and China application serial no. 201810796959.9, filed on Jul. 19, 2018. The entirety of each of the above-mentioned patent applications is hereby incorporated by reference herein and made a part of this specification.

BACKGROUND

Technical Field

The present invention belongs to the technical field of intelligent materials, and more particularly, relates to an electrorheological fluid.

Description of Related Art

An electrorheological fluid (ERF) is an important intelligent material, which is usually a suspension system formed by dispersing a dielectric particle with a high dielectric constant and a low conductivity in insulating oil with a low dielectric constant. The electrorheological fluid is in a fluid state in the absence of an external electric field, and when the external electric field is applied to the electrorheological fluid, a shear stress of the electrorheological fluid is increased with the increase of the electric field. When the electric field is large enough, the electrorheological fluid is converted into a solid-like substance. Moreover, the shear stress conversion is reversible and continuously adjustable, and a response time is on a millisecond scale. Therefore, the electrorheological fluid can be used in a damping system, a shock absorber, a continuously variable transmission, a valve, an electromechanical control coupler and the like.

At present, the electrorheological fluid can be divided into two types: the first type is a traditional electrorheological fluid, i.e., a dielectric electrorheological fluid; and the second type is a giant electrorheological fluid, i.e., a polar molecular electrorheological fluid. A shear stress of the traditional electrorheological fluid is too low (<10 kPa) either theoretically or experimentally to be practical. The giant electrorheological fluid has a very high shear stress (>100 kPa), and the key to produce a high shear stress in the electric field lies in the action of polar molecules. The polar molecules can be desorbed, decomposed and volatilized under the action of mechanical friction, high temperature, etc., and therefore, the polar molecular giant electrorheological fluid has very poor service life and temperature stability and is not practical.

SUMMARY

In order to overcome the deficiencies in the prior art, the present invention provides an electrorheological fluid containing conductor particles, and the electrorheological fluid has characteristics of high shear stress, small leakage current, long service life and good temperature stability. Meanwhile, the present invention provides a preparation method of the electrorheological fluid.

In order to achieve the objectives above, the following technical solutions are adopted in the present invention.

An electrorheological fluid includes a dielectric particle, a conductor particle and insulating oil, wherein the dielectric particle is evenly dispersed in the insulating oil, and the conductor particle is evenly dispersed in the insulating oil or inlaid in an interior and on a surface of the dielectric particle.

Further, the dielectric particle has a dielectric constant greater than 10 and a resistivity greater than 10 Ω·m.

Further, the dielectric particle is selected from one or more of $TiO_2$, $CaTiO_3$, $BaTiO_3$, $SrTiO_3$ and $LaTiO_3$.

Further, when a temperature is less than 20° C., the conductor particle is a solid with a resistivity less than $10^{-3}$ Ω·m, and the conductor particle is selected from one or more of metal, carbon and a conductive organic matter.

Further, the metal is one or more of Ag, Al, Au, Cu, Fe, Hf, In, Nd, Ni, Pd, Pt, Rh, Ru, Sm, Sn, Ti, V, Y and Zr;

the carbon is one or more of amorphous carbon, graphite, graphene and reduced graphene oxide; and the conductive organic matter is one or more of polyacetylene, polythiophene, polypyrrole, polyaniline, polyphenylene, polyphenylenevinylene and polydiacetylene.

Further, the insulating oil is one or more of silicone oil, mineral oil, engine oil and hydrocarbon oil.

Further, a shape of the dielectric particle or the conductor particle is a sphere, a cuboid, a tetrahedron, an irregular polyhedron or any shape.

As one of the implementations, the dielectric particle and the conductor particle are evenly dispersed in the insulating oil; and the dielectric particle has a diameter of 0.1 μm to 10 μm, and the conductor particle has a diameter of 0.2 nm to 100 nm.

The present invention further provides a preparation method of the electrorheological fluid above, which includes the following steps:

S1: mixing 1 to 10 parts of the conductor particle with 50 to 200 parts of the insulating oil, and grinding or ultrasonically dispersing the mixture for 10 minutes to 100 minutes to obtain a conductor particle/insulating oil suspension;

S2: adding 50 to 500 parts of the dielectric particle into the conductor particle/insulating oil suspension, and grinding the mixture to obtain an electrorheological fluid containing trace water; and S3: performing heat treatment to the electrorheological fluid containing trace water obtained in S2 at 120° C. to 200° C. for 1 hour to remove water and obtain the electrorheological fluid.

As another implementation, the conductor particle is inlaid in the interior and on the surface of the dielectric particle; the dielectric particle has a radius of 50 nm to 5 μm; and the conductor particle has a radius of 0.2 nm to 100 nm.

The present invention further provides a preparation method of the electrorheological fluid above, which includes the following steps:

S1: dissolving 1 g to 10 g of a carbon-source organic matter with 20 g to 30 g of distilled water and 40 g to 400 g of absolute ethyl alcohol to prepare a fluid A; and dissolving 10 g to 100 g of butyl titanate in 80 g to 800 g of absolute ethyl alcohol to prepare a fluid B;

S2: slowly dripping the fluid A into the fluid B which is continuously and violently stirred, and after dripping the fluid A into the fluid B, centrifuging the mixed fluid to obtain a precipitate;

S3: washing and drying the precipitate to obtain a dried powder;

S4: putting the dried powder into a tube furnace, and treating at 500° C. to 600° C. under a vacuum or nitrogen atmosphere;

S5: mixing the obtained powder with the insulating oil to prepare the electrorheological fluid; and S6: performing heat treatment to the electrorheological fluid at 150° C. to 170° C. to remove water.

Further, the carbon-source organic matter is glucose or sucrose.

Compared with the prior art, the present invention has the following beneficial effects.

1) According to the present invention, a nano-sized conductor particle is added into the dielectric particle and the insulating oil, so that the shear stress of the electrorheological fluid is obviously increased. The conductor particle is evenly dispersed in the insulating oil or inlaid in the interior and on the surface of the dielectric particle, so that the electrorheological fluid has the advantages of high shear stress, long service life, good temperature stability and small leakage current.

2) All components of the electrorheological fluid are insensitive to mechanical friction, and have good abrasion resistance and long service life. The electrorheological fluid of the present invention can resist high and low temperatures and has a wide temperature application range.

3) The preparation method of the electrorheological fluid according to the present invention is simple, and all raw materials have mature production processes, thus being suitable for large-scale production.

4) The electrorheological fluid according to the present invention can be widely applied in the fields of dampers, shock absorbers, micro-flow control, electromechanical integration and the like.

DESCRIPTION OF THE EMBODIMENTS

The preferred embodiments of the present invention are described below with reference to the accompanying drawings. It should be understood that the preferred embodiments described herein are merely used for illustrating and explaining the present invention, but are not intended to limit the present invention.

The methods and devices used in the following embodiments are conventional unless otherwise specified.

The raw materials, reagents, etc. used in the following embodiments are commercially available unless otherwise specified.

Figure 5:
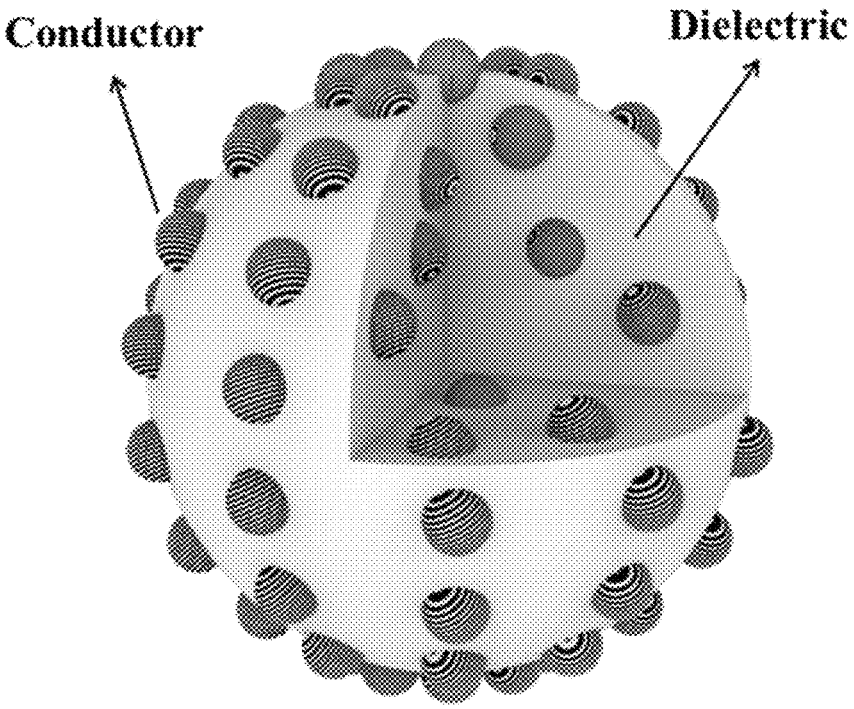
FIG. 5 is a structural diagram of a dielectric particle inlaid with conductor particles.

An electrorheological fluid in the following embodiments includes a dielectric particle, a conductor particle and insulating oil, wherein the dielectric particle is evenly dispersed in the insulating oil, and the conductor particle is evenly dispersed in the insulating oil (FIG. 1) or inlaid in an interior and on a surface of the dielectric particle (FIG. 5).

In particular, the dielectric particle has a dielectric constant greater than 10 and a resistivity greater than 10 Ω·m.

The dielectric particle is selected from one or more of $TiO_2$, $CaTiO_3$, $BaTiO_3$, $SrTiO_3$ and $LaTiO_3$.

When a temperature is less than 20° C., the conductor particle is a solid with a resistivity less than $10^{-3}$ Ω·m, and the conductor particle is selected from one or more of metal, carbon and a conductive organic matter.

The metal is one or more of Ag, Al, Au, Cu, Fe, Hf, In, Nd, Ni, Pd, Pt, Rh, Ru, Sm, Sn, Ti, V, Y and Zr.

The carbon is one or more of amorphous carbon, graphite, graphene and reduced graphene oxide; the conductive organic matter is one or more of polyacetylene, polythiophene, polypyrrole, polyaniline, polyphenylene, polyphenylenevinylene and polydiacetylene; and the insulating oil is one or more of silicone oil, mineral oil, engine oil and hydrocarbon oil.

A shape of the dielectric particle is a sphere, a cuboid, a tetrahedron, an irregular polyhedron or any shape.

The following Embodiments 1 to 5 show the cases where the dielectric particle and the conductor particle are evenly dispersed in the insulating oil, wherein the dielectric particle has a diameter of 0.1 μm to 10 μm, and the conductor particle has a diameter of 0.2 nm to 50 nm.

Embodiment 1

Figure 1:
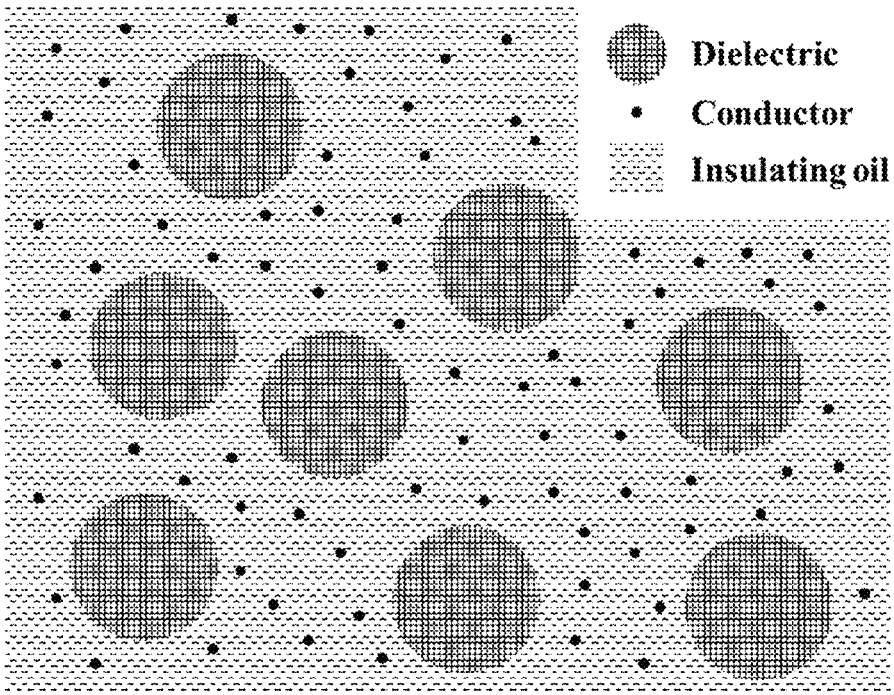
FIG. 1 is a schematic diagram illustrating composition of an electrorheological fluid that the dielectric particle is evenly dispersed in the insulating oil, and the conductor particle is evenly dispersed in the insulating oil.

A preparation method of an electrorheological fluid was as follows:

1 g of carbon particles and 200 g of dimethyl silicone oil were mixed, and ultrasonically dispersed for 30 minutes to obtain a carbon-silicone oil suspension; 50 g of titanium dioxide particles were added into the carbon-silicone oil suspension and carefully grinded to obtain an electrorheological fluid containing water, and finally, heat treatment was performed to the electrorheological fluid containing water at 150° C. for 2 hours to remove water, thus obtaining the electrorheological fluid. The electrorheological fluid according to the present embodiment was a conductor-dispersed electrorheological fluid, as shown in FIG. 1.

In particular, the carbon particle had a density of 0.05 g/cm$^3$ and a diameter of 20 nm, the dimethyl silicone oil had a viscosity of 20 cSt and a density of 0.97 g/cm$^3$, and the titanium dioxide particle had a density of 4.2 g/cm$^3$ and a diameter of 1.5 μm.

Figure 2:
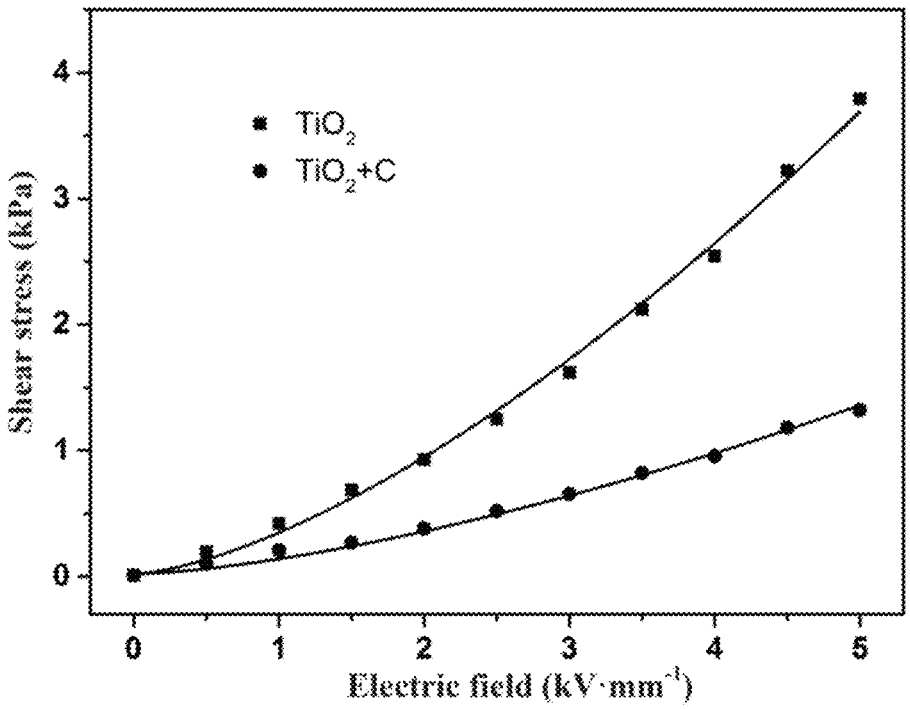
FIG. 2 is a diagram illustrating a relationship between a shear stress of an electrorheological fluid in Embodiment 1 of the present invention and an electric field strength.

A relationship between a shear stress of the electrorheological fluid and an electric field strength is shown in FIG. 2, wherein an upper curve shows a relationship between a shear stress of the conductor-dispersed electrorheological fluid obtained in the present embodiment and the electric field strength, and a lower curve shows a relationship between a shear stress of the electrorheological fluid without carbon particles and the electric field strength, which shows that the shear stress is greatly improved after the carbon particles are added.

Embodiment 2

A preparation method of an electrorheological fluid was as follows:

10 g of silver particles and 200 g of silicone oil were firstly mixed, and grinded to obtain a silver-silicone oil suspension; 50 g of titanium dioxide particles were added into the silver-silicone oil suspension and carefully grinded to obtain an electrorheological fluid, and finally, heat treatment was performed to the electrorheological fluid containing water at 200° C. for 1 hour to remove water.

In particular, the silver particle had a diameter of 50 nm, the silicone oil had a viscosity of 300 cSt and a density of 0.97 g/cm$^3$, and the titanium dioxide particle had a diameter of 1.5 μm.

Figure 3:
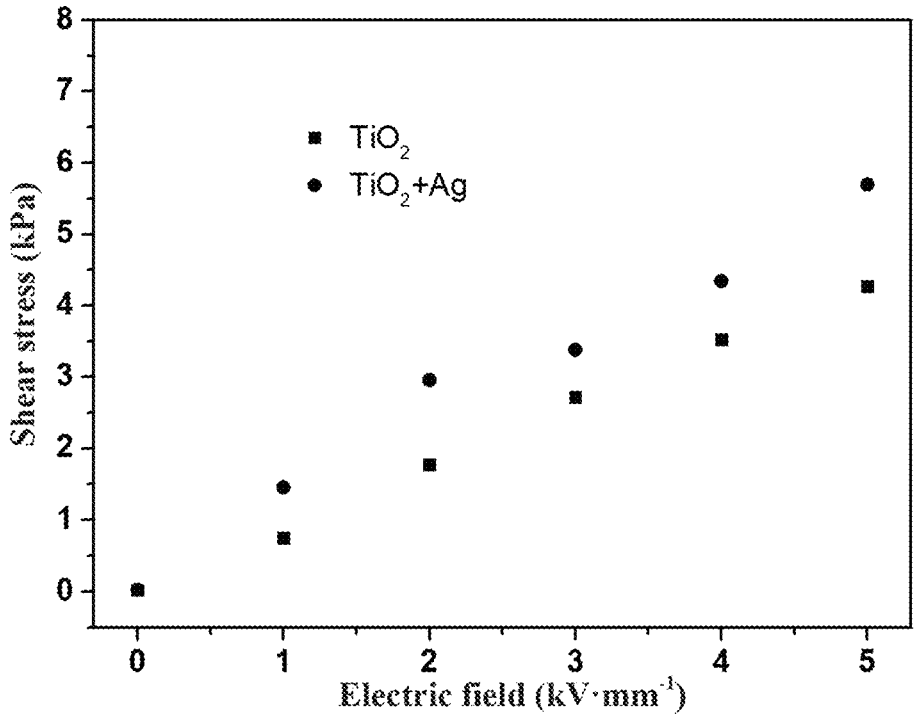
FIG. 3 is a diagram illustrating a relationship between a shear stress of an electrorheological fluid in Embodiment 2 of the present invention and the electric field strength.

A relationship between a shear stress of the electrorheological fluid and an electric field strength is shown in FIG. 3, wherein an upper curve shows a relationship between a shear stress of the conductor-dispersed electrorheological fluid obtained in the present embodiment and the electric field strength, and a lower curve shows a relationship between a shear stress of the electrorheological fluid without carbon particles and the electric field strength, which shows that the shear stress is improved after the silver particles are added.

Embodiment 3

A preparation method of an electrorheological fluid was as follows:

5 g of carbon particles and 150 g of dimethyl silicone oil were mixed, and grinded to obtain a carbon-silicone oil suspension; 100 g of titanium dioxide particles were added into the carbon-silicone oil suspension and carefully grinded to obtain an electrorheological fluid, and finally, heat treatment was performed to the electrorheological fluid containing water at 170° C. for 1 hour to remove water.

In particular, the carbon particle had a density of 0.05 g/cm$^3$ and a diameter of 20 nm, the dimethyl silicone oil had a viscosity of 300 cSt and a density of 0.97 g/cm$^3$, and the titanium dioxide particle had a density of 4.2 g/cm$^3$ and a diameter of 1.5 μm.

Figure 4:
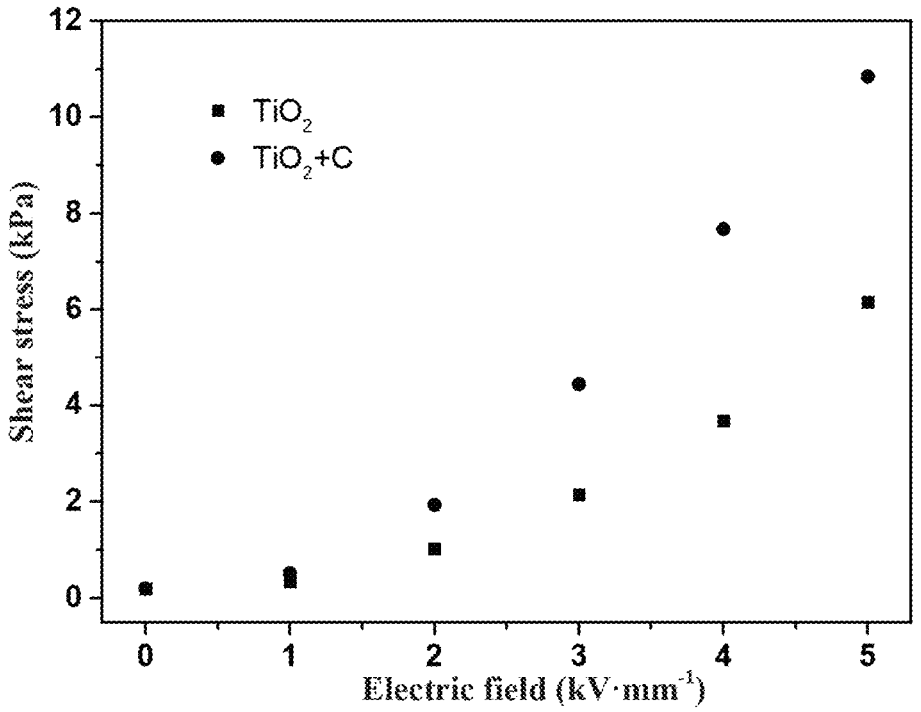
FIG. 4 is a diagram illustrating a relationship between a shear stress of an electrorheological fluid in Embodiment 3 of the present invention and the electric field strength.

A relationship between a shear stress of the electrorheological fluid and an electric field strength is shown in FIG. 4, wherein an upper curve shows a relationship between a shear stress of the conductor-dispersed electrorheological fluid obtained in the present embodiment and the electric field strength, and a lower curve shows a relationship between a shear stress of the electrorheological fluid without carbon particles and the electric field strength, which shows that the shear stress is greatly improved after the carbon particles are added.

Embodiment 4

A preparation method of an electrorheological fluid was as follows:

1 g of carbon particles and 50 g of dimethyl silicone oil were mixed to obtain a carbon-silicone oil suspension; 100 g of titanium dioxide particles were added into the carbon-silicone oil suspension and carefully grinded to obtain an electrorheological fluid, and finally, heat treatment was performed to the electrorheological fluid containing water at 150° C. for 1 hour to remove water.

The carbon particle had a density of 0.05 g/cm$^3$ and a diameter of 20 nm, the dimethyl silicone oil had a viscosity of 300 cSt and a density of 0.97 g/cm$^3$, and the titanium dioxide particle had a density of 4.2 g/cm$^3$ and a diameter of 1.5 μm.

Embodiment 5

A preparation method of an electrorheological fluid was as follows:

1 g of gold particles and 150 g of dimethyl silicone oil were mixed to obtain a gold-silicone oil suspension; 100 g of titanium dioxide particles were added into the gold-silicone oil suspension and carefully grinded to obtain an electrorheological fluid, and finally, heat treatment was performed to the electrorheological fluid containing water at 150° C. for 2 hours to remove water.

The gold particle had a diameter of 20 nm, the dimethyl silicone oil had a viscosity of 20 cSt and a density of 0.97 g/cm$^3$, and the titanium dioxide particle had a density of 3.8 g/cm$^3$ and a diameter of 1.2 μm.

The following Embodiments 6 to 10 show the cases where the conductor particle is inlaid in an interior and on a surface of the dielectric particle, wherein the dielectric particle has a radius of 50 nm to 5 μm; and the conductor particle has a radius of 0.2 nm to 100 nm.

Embodiment 6

Figure 6:
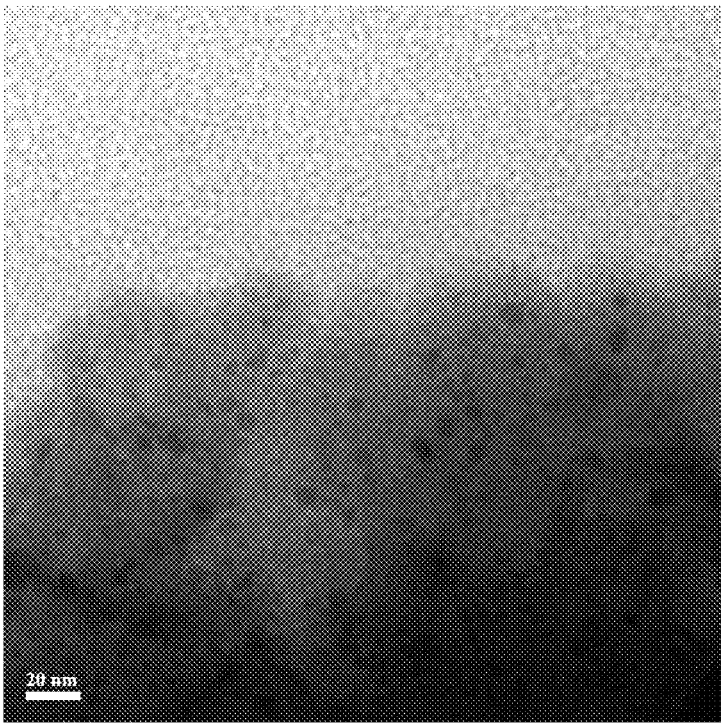
FIG. 6 is a transmission electron microscope photo of a black powder in Embodiment 6.
Figure 7:
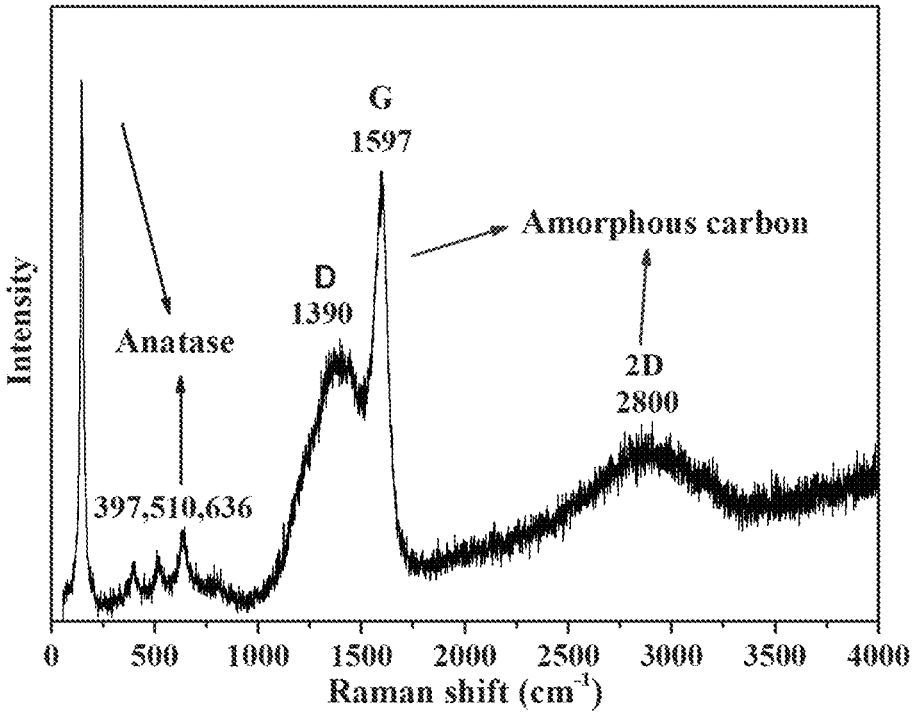
FIG. 7 is a Raman spectrum of the black powder in Embodiment 6.

A preparation method of an electrorheological fluid was as follows:

1 g of glucose was firstly dissolved with 30 g of distilled water and 160 g of absolute ethyl alcohol to prepare a fluid A; 30 g of butyl titanate was dissolved in 240 g of absolute ethyl alcohol to prepare a fluid B; the fluid A was slowly dripped into the fluid B which was continuously and violently stirred, half an hour after the fluid A was dripped into the fluid B, the mixed fluid was centrifuged to obtain a white precipitate, and the precipitate was washed with water and absolute ethyl alcohol twice respectively and then dried to obtain a dried powder. The dried powder was put into a tube furnace and treated for 3 hours under a nitrogen atmosphere at 600° C. to obtain a black powder; the black powder was a dielectric particle inlaid with a conductor particle, and a structural diagram thereof was shown in FIG. 5; a transmission electron microscope photo of the black powder was shown in FIG. 6, and the deeper color part was the carbon particle; and a Raman spectrum was shown in FIG. 7, titanium dioxide (dielectric) was anatase, and carbon was amorphous carbon (conductor). FIG. 6 and FIG. 7 illustrate the structural shown in FIG. 5 has been successfully prepared.

Figure 8:
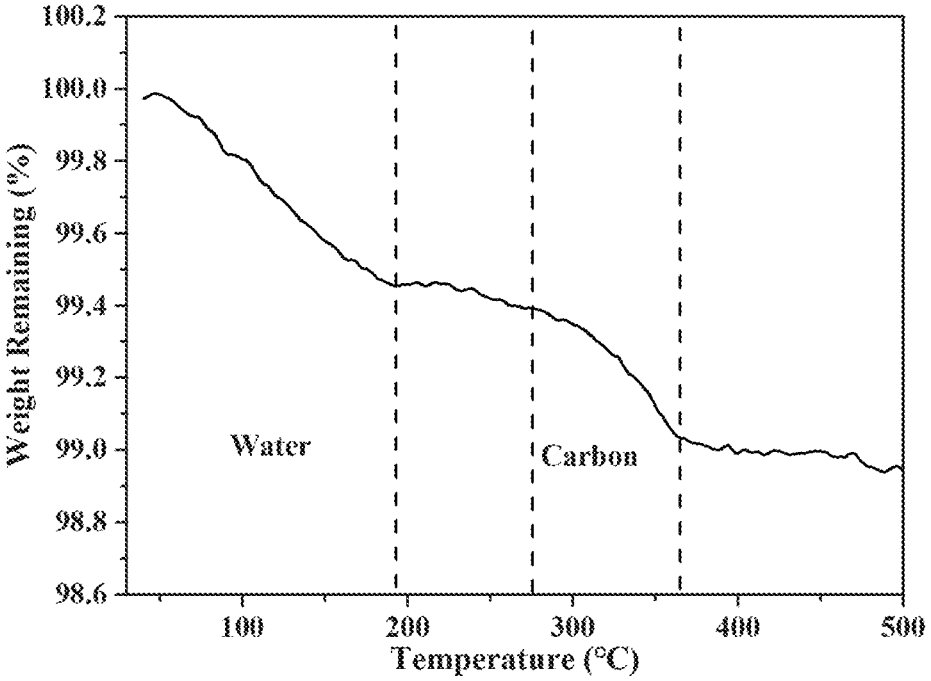
FIG. 8 is a weight loss curve (atmosphere: air) of the black powder in Embodiment 6.

A thermogravimetric weight loss curve was shown in FIG. 8, the weight loss of physically adsorbed water occurred at 190° C., and the weight loss of carbon occurred at 290° C. and above. 2 g of the black powder and 1 g of silicone oil with a viscosity of 300 cSt were mixed, and carefully grinded to obtain an electrorheological fluid, and finally, heat treatment was performed to the electrorheological fluid at 170° C. for 2 hours to remove water.

Figure 9:
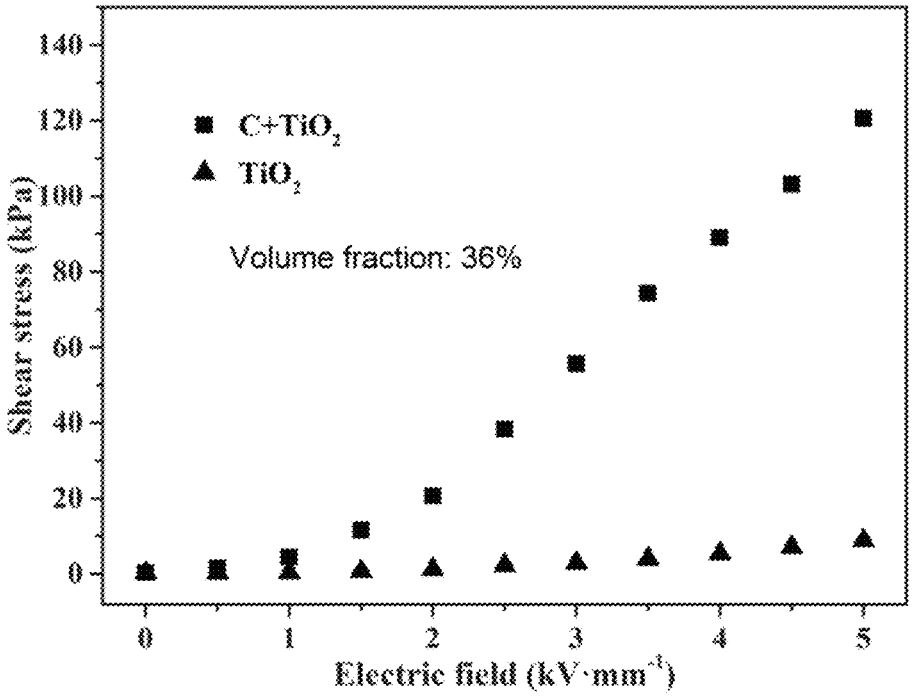
FIG. 9 is a diagram illustrating a relationship between a shear stress of an electrorheological fluid in Embodiment 6 and the electric field strength.
Figure 10:
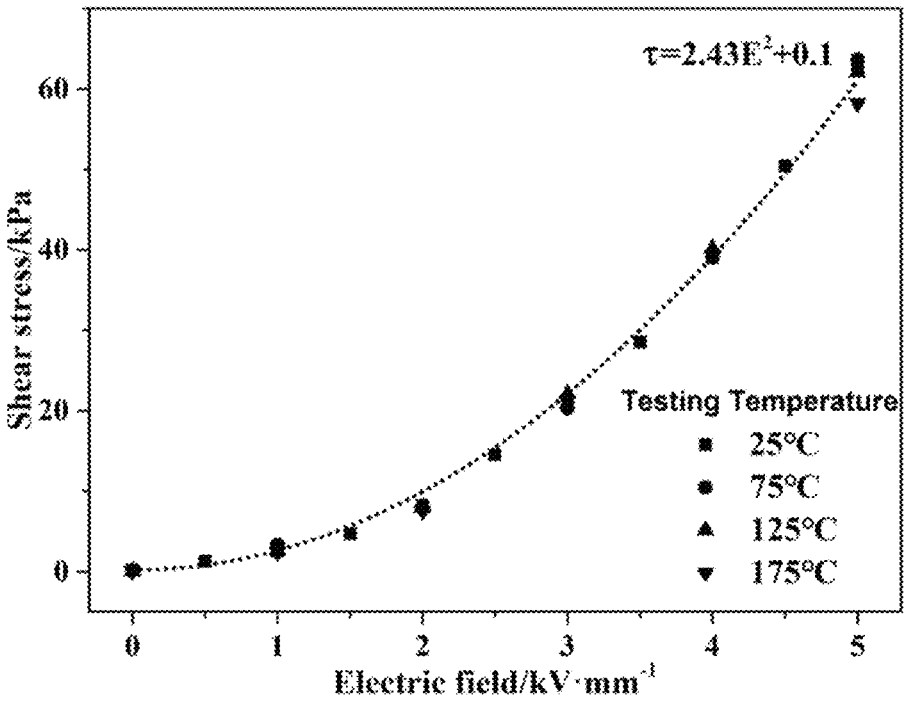
FIG. 10 is a diagram illustrating a relationship between the shear stress of the electrorheological fluid in Embodiment 6 and the electric field strength at different temperatures.
Figure 11:
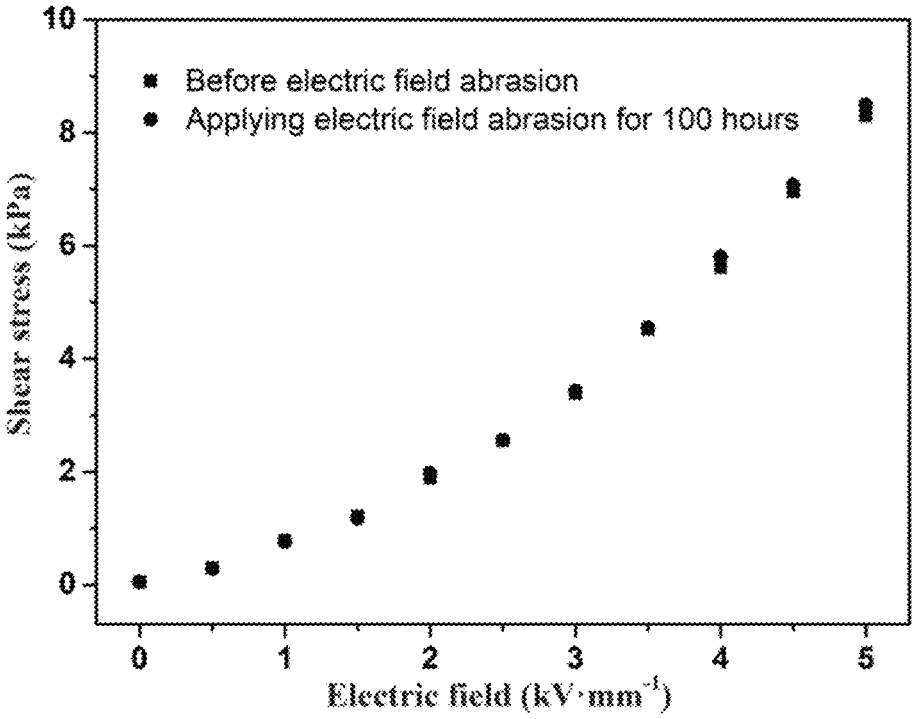
FIG. 11 is a diagram illustrating a relationship between the shear stress of the electrorheological fluid in Embodiment 6 and the electric field strength before and after abrasion.

A relationship between a shear stress of the electrorheological fluid and an electric field strength is shown in FIG. 9, wherein a lower curve in FIG. 9 shows a case without adding carbon, which shows that the shear stress is greatly improved after adding carbon; FIG. 10 is a diagram illustrating a relationship between the shear stress and the electric field strength at different temperatures (a mass fraction is slightly lower than that in FIG. 9), which shows that the electrorheological fluid has good stability at a temperature of 25° C. to 170° C.; and FIG. 11 is a diagram illustrating a relationship between the shear stress and the electric field strength before and after abrasion, which shows that the electrorheological fluid has long service life.

Embodiment 7

A preparation method of an electrorheological fluid was as follows:

1 g of sucrose was firstly dissolved with 30 g of distilled water and 160 g of absolute ethyl alcohol to prepare a fluid A; 30 g of butyl titanate was dissolved in 240 g of absolute ethyl alcohol to prepare a fluid B; the fluid A was slowly dripped into the fluid B which was continuously and violently stirred, half an hour after the fluid A was dripped into the fluid B the mixed fluid was centrifuged to obtain a white precipitate, and the precipitate was washed with water and absolute ethyl alcohol twice respectively and then dried to obtain a dried powder. The dried powder was put into a tube furnace and treated for 3 hours under a nitrogen atmosphere at 500° C. to obtain a grey powder. 2 g of the grey powder and 1 g of silicone oil with a viscosity of 50 cSt were mixed, and carefully grinded to obtain an electrorheological fluid, and finally, heat treatment was performed to the electrorheological fluid at 150° C. for 2 hours to remove water.

Figure 12:
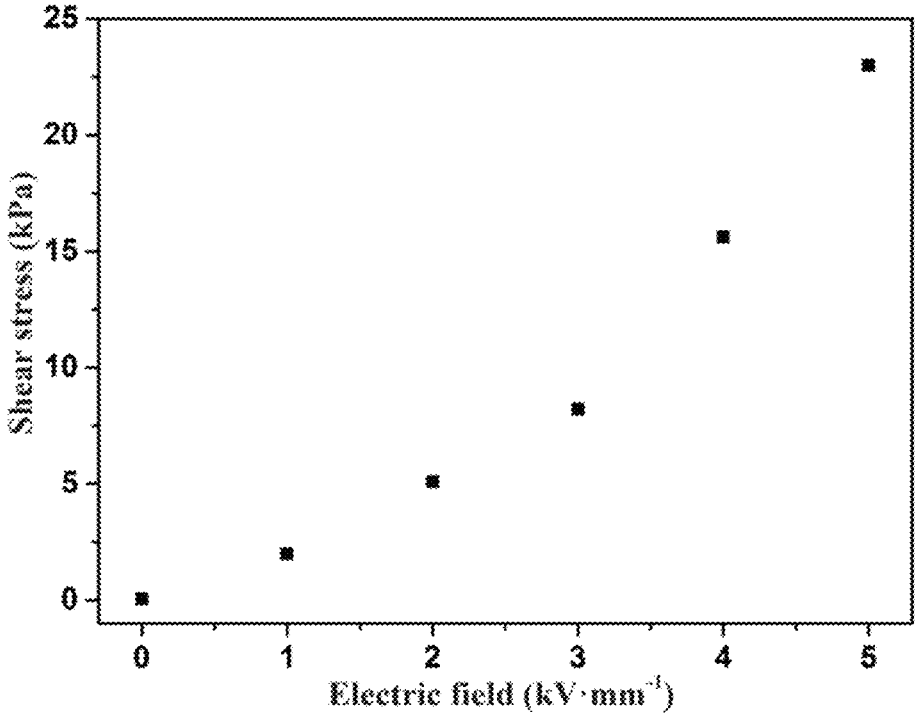
FIG. 12 is a diagram illustrating a relationship between a shear stress of an electrorheological fluid in Embodiment 7 and the electric field strength.

A relationship between a shear stress of the electrorheological fluid and an electric field strength is shown in FIG. 12, which shows that after adding carbon, the shear stress is much higher than that without adding carbon (a lower curve in FIG. 9 shows a case without adding carbon).

Embodiment 8

A preparation method of an electrorheological fluid was as follows:

1 g of sucrose was firstly dissolved with 20 g of distilled water and 160 g of absolute ethyl alcohol to prepare a fluid A; 30 g of butyl titanate was dissolved in 240 g of absolute ethyl alcohol to prepare a fluid B; the fluid A was slowly dripped into the fluid B which was continuously and violently stirred, half an hour after the fluid A was dripped into the fluid B, the mixed fluid was centrifuged to obtain a white precipitate, and the precipitate was washed with water and absolute ethyl alcohol twice respectively and then dried to obtain a dried powder. The dried powder was put into a tube furnace and treated for 3 hours under a vacuum atmosphere at 500° C. to obtain a grey powder. 1 g of the grey powder and 1 g of silicone oil with a viscosity of 20 cSt were mixed, and carefully grinded to obtain an electrorheological fluid, and finally, heat treatment was performed to the electrorheological fluid at 150° C. for 2 hours to remove water.

Figure 13:
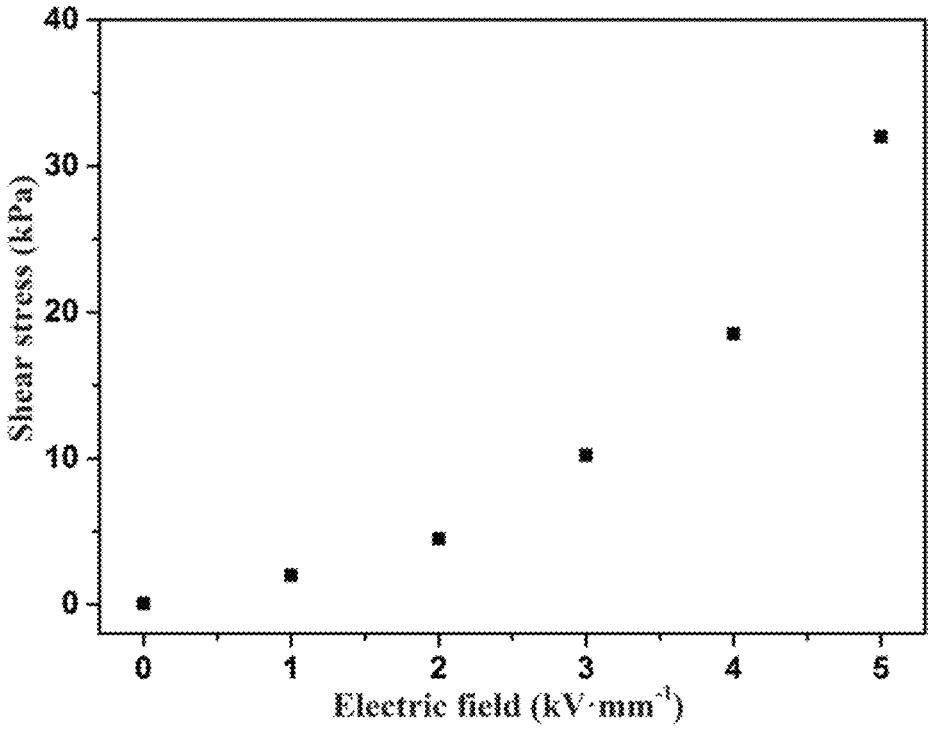
FIG. 13 is a diagram illustrating a relationship between a shear stress of an electrorheological fluid in Embodiment 8 and the electric field strength.

A relationship between a shear stress of the electrorheological fluid and an electric field strength is shown in FIG. 13, which shows that after adding carbon, the shear stress is much higher than that without carbon (a lower curve in FIG. 9 shows a case without carbon).

Embodiment 9

A preparation method of an electrorheological fluid was as follows:

2 g of sucrose was firstly dissolved with 22 g of distilled water and 40 g of absolute ethyl alcohol to prepare a fluid A; 10 g of butyl titanate was dissolved in 80 g of absolute ethyl alcohol to prepare a fluid B; the fluid A was slowly dripped into the fluid B which was continuously and violently stirred, the mixed fluid was centrifuged half an hour after dripping to obtain a white precipitate, and the precipitate was washed with water and absolute ethyl alcohol twice respectively and then dried to obtain a dried powder. The dried powder was put into a tube furnace and treated for 3 hours under a vacuum atmosphere at 500° C. to obtain a grey powder. 1 g of the grey powder and 1 g of silicone oil with a viscosity of 100 cSt were mixed, and carefully grinded to obtain an electrorheological fluid, and finally, heat treatment was performed to the electrorheological fluid at 170° C. for 1 hour to remove water.

Embodiment 10

A preparation method of an electrorheological fluid was as follows:

10 g of sucrose was firstly dissolved with 28 g of distilled water and 400 g of absolute ethyl alcohol to prepare a fluid A; 100 g of butyl titanate was dissolved in 800 g of absolute ethyl alcohol to prepare a fluid B; the fluid A was slowly dripped into the fluid B which was continuously and violently stirred, half an hour after the fluid A was dripped into the fluid B, the mixed fluid was centrifuged to obtain a white precipitate, and the precipitate was washed with water and absolute ethyl alcohol twice respectively and then dried to obtain a dried powder. The dried powder was put into a tube furnace and treated for 3 hours under a vacuum atmosphere at 500° C. to obtain a grey powder. 1 g of the grey powder and 1 g of silicone oil with a viscosity of 200 cSt were mixed, and carefully grinded to obtain an electrorheological fluid, and finally, heat treatment was performed to the electrorheological fluid at 170° C. for 3 hours to remove water.

Obviously, the above-described embodiments of the present invention are merely examples for clearly describing the present invention, rather than limiting the embodiments of the present invention. Those of ordinary skills in the art can also make other different forms of changes or variations on the basis of the description above. All the embodiments need not and cannot be exhaustive here. Any modifications, equivalents, and improvements made within the spirit and principle of the present invention shall be included within the scope of protection claimed in the present invention.

What is claimed is:

1. An electrorheological fluid, comprising a dielectric particle, a plurality of conductor particles and insulating oil, wherein a diameter of the plurality of conductor particles is smaller than a diameter of the dielectric particle, and a radius of the plurality of conductor particles is 0.2 nm to 100 nm, the plurality of conductor particles are inlaid and dispersed in an interior and on a surface of the dielectric particle, and the dielectric particle inlaid and dispersed with the plurality of conductive particles is evenly dispersed in the insulating oil.

2. The electrorheological fluid according to claim 1, wherein the dielectric particle has a dielectric constant greater than 10 and a resistivity greater than 10 Ω·m.

3. The electrorheological fluid according to claim 2, wherein the dielectric particle is selected from one or more of $TiO_2$, $CaTiO_3$, $BaTiO_3$, $SrTiO_3$ and $LaTiO_3$.

4. The electrorheological fluid according to claim 1, wherein when a temperature is less than 20° C., the plurality of conductor particles are a solid with a resistivity less than $10^{-3}$ Ω·m, and the plurality of conductor particles are selected from one or more of metal, carbon and a conductive organic matter.

5. The electrorheological fluid according to claim 4, wherein the metal is one or more of Ag, Al, Au, Cu, Fe, Hf, In, Nd, Ni, Pd, Pt, Rh, Ru, Sm, Sn, Ti, V, Y and Zr;

the carbon is one or more of amorphous carbon, graphite, graphene and reduced graphene oxide; and the conductive organic matter is one or more of polyacetylene, polythiophene, polypyrrole, polyaniline, polyphenylene, polyphenylenevinylene and polydiacetylene.

6. The electrorheological fluid according to claim 1, wherein the insulating oil is one or more of silicone oil, mineral oil, engine oil and hydrocarbon oil.

7. The electrorheological fluid according to claim 1, wherein a shape of the dielectric particle is a sphere, a cuboid, a tetrahedron, an irregular polyhedron or any shape.

8. The electrorheological fluid according to claim 1, wherein the plurality of conductor particles are inlaid and dispersed in the interior and on the surface of the dielectric particle; the dielectric particle has a radius of 50 nm to 5 μm.

* * * * *